US008579283B2

(12) United States Patent
Isobe et al.

(10) Patent No.: US 8,579,283 B2
(45) Date of Patent: Nov. 12, 2013

(54) IMAGE FORMING APPARATUS

(75) Inventors: Akifumi Isobe, Hidaka (JP); Masashi Sugano, Hachioji (JP); Akinori Kimata, Toyokawa (JP); Katsunori Takahashi, Hachioji (JP); Kenji Tamaki, Tokorozawa (JP); Satoshi Shimao, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 13/356,857

(22) Filed: Jan. 24, 2012

(65) Prior Publication Data

US 2012/0200025 A1 Aug. 9, 2012

(30) Foreign Application Priority Data

Feb. 9, 2011 (JP) ..... 2011-025830

(51) Int. Cl.
*B65H 5/00* (2006.01)

(52) U.S. Cl.
USPC ..... 271/225; 271/65; 271/177; 271/185; 271/186

(58) Field of Classification Search
USPC ..... 271/225, 291, 301, 65, 177, 184–186
See application file for complete search history.

(56) References Cited

U.S. PATENT DOCUMENTS 5,421,463 A * 6/1995 Okazaki et al. ..... 209/559
6,422,553 B1 * 7/2002 Asao ..... 270/58.11

FOREIGN PATENT DOCUMENTS

JP 61-222769 A 10/1986
JP 07-043958 A 2/1995

* cited by examiner

*Primary Examiner* — Michael McCullough
(74) *Attorney, Agent, or Firm* — Cantor Colburn LLP

(57) ABSTRACT

Provided is an image forming apparatus which enables quick removal of remaining sheets in the image forming apparatus via an orthogonal reverse section in case a jam occurs inside the image forming apparatus. The image forming apparatus includes a main conveyance section to convey a sheet in the image forming apparatus and to convey the sheet to an ejected sheet section; an orthogonal reverse section to receive the sheet from the main conveyance section and turn over the sheet without swapping a front edge for a rear edge of the sheet by conveying the sheet in a direction perpendicular to a sheet conveyance direction of the main conveyance section and a sheet ejection section to eject the sheet in the orthogonal reverse section outside the orthogonal reverse section along a direction to turn over the sheet by the orthogonal reverse section.

8 Claims, 6 Drawing Sheets

IMAGE FORMING APPARATUS

This application is based on Japanese Patent Application No. 2011-025830 filed on Feb. 9, 2011, in Japanese Patent Office, the entire content of which is hereby incorporated by reference.

TECHNICAL FIELD

The present invention relates to an image forming apparatus wherein a sheet is conveyed inside the apparatus so as to form an image on the sheet and ejected.

BACKGROUND OF THE INVENTION

In the image forming apparatus, the sheet is conveyed in the apparatus for image forming and so forth and then the sheet on which the image is formed is further conveyed inside the apparatus. Also the sheet is turned over as needed and conveyed (refer to Patent Document 1: Unexamined Japanese Patent Application Publication No. S61-222769 and Patent Document 2: Unexamined Japanese Patent Application Publication No. H7-43958). In Patent Document 1, there is disclosed a reverse device provided with a primary storing box to store the sheet printed on its obverse surface disposed in front of a hopper which selectively feeds the sheet one by one, a lateral direction reverse storing box, a longitudinal direction storing box and a reverse roller, wherein the sheet printed on its obverse surface is stored in the primary storing box via a changeover bar, then the sheet is stored in a lateral direction via a lateral direction reverse roller, and the sheet is sent to the longitudinal direction storing box, and then the sheet is turned over in the longitudinal direction by the longitudinal direction reverse roller, thereafter the sheet is sent to the reverse storing box in the longitudinal direction. In Patent Document 2, there is disclosed an image recording apparatus provided with a recording sheet reverse device which turns over the recording sheet 180° around a center line of the recording sheet width in a recording sheet proceeding direction as a rotation axis.

Incidentally, it is difficult to avoid a jam (paper jam) in a conveyance path including the reverse device in course of sheet conveyance. Therefore, a control section to control entire image forming apparatus detects the jam and stops the image forming apparatus when the jam is detected so that a user can remove the jammed sheet and a sheet remaining in the conveyance path.

Patent Document 1: Unexamined Japanese Patent Application Publication No. S61-222769

Patent Document 2: Unexamined Japanese Patent Application Publication No. H7-43958

However, with speeding up of the image forming function and to cope with a large size sheet, size of the image forming apparatus has increased, accordingly apparatuses to carry a large number of remaining sheets in side has appeared. Thus it leads a laborious job to address the jam and increasing down time. For example, if a jam occurs in an image forming apparatus configured with a plurality of units, to conduct jam processing, the plurality of the units has to be withdrawn respectively. Also since the locations of remaining sheets can not be recognized, there occurs a problem that a job to repeat the same operation many times occurs. Through in conventional apparatuses countermeasures to efficiently remove the jammed sheet and the remaining sheet from the apparatus have not been taken.

SUMMARY

The present invention has one aspect to solve the above problems and an object of the present invention is to provide an image forming apparatus to enable removing the sheet from the orthogonal reversal section besides the ordinal sheet ejection section.

To achieve the above object the image forming apparatus reflecting one aspect of the present invention comprises:

a main conveyance section to convey a sheet inside the image forming apparatus and to convey the sheet to a sheet discharge section;

an orthogonal reverse section to receive the sheet from the main conveyance section and to turn over the sheet without swapping a front edge for a rear edge of the sheet by conveying the sheet in a direction perpendicular to a sheet conveyance direction of the main conveyance section, and a sheet ejection section to eject the sheet in the orthogonal reverse section outside along a direction to turn over the sheet by the orthogonal reverse section.

According to the present embodiment, the sheet removing section can move the sheet in the orthogonal reverse section, outside the orthogonal reverse section, along a direction perpendicular to a direction to turn over the sheet, wherein the orthogonal reverse section is to turn over the sheet in course of conveying by changing the sheet conveyance direction to a direction perpendicular to the sheet conveyance direction, thus the sheets in the main conveyance section and the reverse conveyance section can be ejected via the orthogonal reverse section. For example, in case a jam occurs inside the image forming apparatus, the remaining undamaged sheets in each portion in the image forming apparatus are conveyed to the orthogonal reverse section and the sheets can be ejected to the front surface side of the image forming apparatus using a part of a mechanism of the orthogonal reverse section without withdrawing the unit.

Incidentally, it is preferred that the sheet ejection section to eject the sheet from the orthogonal reverse section moves the sheet in the orthogonal reverse section forward and backward along the direction in which the orthogonal reverse section turns over the sheet so as to move the sheet outside the orthogonal reverse section. Whereby, the sheet can be ejected by using the mechanism of the orthogonal reverse section without using a complicated mechanism. It is preferred that the sheet is ejected to the front surface side of the image forming apparatus. Thereby, the operator can easily handle the ejected sheet.

A stack section to stack the sheet can be provided for sheet ejection. When a plurality of the sheets are ejected from the image forming apparatus, by stacking the sheets in the stacker tentatively, the sheets can be handled easily. For example, after ejecting the sheet remaining in the stacking section, the sheets stacked in the stacking section can be removed outside the apparatus in a batch.

Also, in case the sheets stacked in the stacker are removed in the batch, the above ejection operation can be carried out automatically by detecting time elapsed to convey the remaining sheet or by detecting the sheet to the stacking section or can be carried out by an operation instruction by the operator. An ejection instruction by the operator can be conducted at the ejection instruction section. The ejection instruction section can be a one which uses the operation section disposed at the image forming apparatus or a one provided with an independent ejection button which enables the ejection instruction by operating the button, Sheet stacking in the stacking section is conducted while the door at the front surface side of the orthogonal reversal is closed and it is possible that while the door is open, sheet ejection to the front surface side of the apparatus is conducted without stacking sheet in the stacking section.

Also, the image forming apparatus can be provided with a jam detection section to detect the jamming sheet. The jam detection section can be configured with a sheet sensor disposed at the main conveyance section or the reverse conveyance section and a control section to judge occurrence of the jam by receiving an output from the sheet sensor. The control section judges that the jam has occurred in case the sheet being conveyed is not detected by the sensor after a predetermined time period has elapsed from an estimated time of sheet detection. The estimated time of sheet detection can be judged by the control section based on time of sheet conveyance from the sheet feeding tray and so forth, sheet conveyance speed and the position of the sheet sensor. The control section also can judge whether the jam occurred, a position where the jam occurred and an area where the jam occurred. Also, the control section controls operation of the image forming apparatus based on the judgment that the jam occurred. For example, the control section stops sheet feeding from the sheet feeding tray and an image forming operation, also stops sheet conveyance partially and operates sheet conveyance partially.

The control section can conduct control of remaining sheet ejection, wherein the sheet remaining in the main conveyance section or the reverse conveyance section, which can be conveyed to the orthogonal reverse section without passing through the position of the jam, is conveyed to the orthogonal reverse section via the main conveyance section or the reverse conveyance section and the aforesaid conveyed sheet or a sheet remaining in the orthogonal reverse section is ejected outside the orthogonal reverse section by the sheet ejection section. Thereby the sheet remaining in the image forming apparatus can be ejected outside the orthogonal reverse section as much as possible. Incidentally, control of the remaining sheet ejection can be conducted automatically in accordance with the judgment that the jam occurred or can be conducted with a trigger such as the operation instruction of the operator or detection of door opening.

DETAILED DESCRIPTION OF PREFERRED EMBODIMENTS

Figure 1:
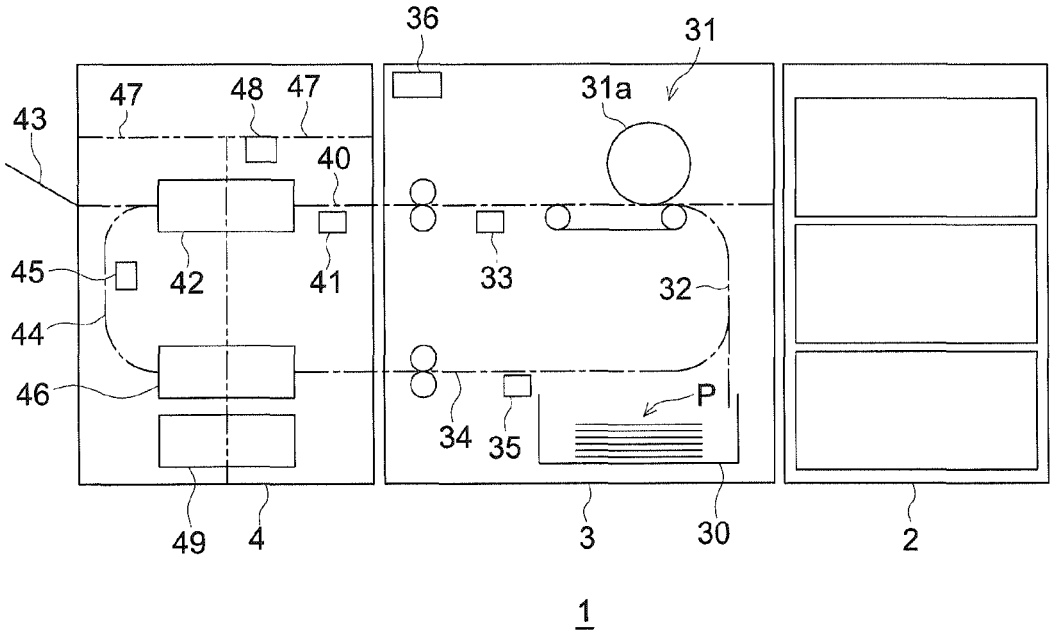
FIG. 1 is a view showing an outline of a mechanical configuration of an image forming apparatus related to an embodiment of the present invention.

An embodiment of the present invention will be described as follow. FIG. 1 a view showing an outline of an image forming apparatus 1 related to an embodiment of the present invention. The image forming apparatus is provided with a large capacity sheet feeding device 2, an image forming apparatus main body 3 and a fixing device 4. The large capacity sheet feeding device 2 and the image forming apparatus main body 3 are connected each other so that the sheet can be conveyed from the large capacity sheet feeding device 2 to the image forming apparatus main body 3 and signals can be communicated. Also the image forming apparatus main body 3 and the fixing device 4 are connected so that the sheet can be conveyed from the image forming apparatus main body 3 to the fixing device 4 and signals can be communicated. Incidentally, as the present embodiment, the image forming apparatus 1 can be configured with only the image forming apparatus main body 3 and the fixing device 4, and other peripheral devices can be connected to the image forming apparatus 1.

The large capacity sheet feeding device 2 is provided with one or more the sheet cassettes to store the sheet and feed the sheet stored in the sheet feeding cassette to the image forming apparatus main body 3. The image forming apparatus main body 3 is provide with a sheet feeding section 30 having sheet feeding trays, image forming section 31 to form an image on the sheet, an image forming main conveyance section 32 to convey the sheet, an image forming reverse conveyance section 34 to merge into the image forming main conveyance section 32 and a control section 36 to control entire image forming apparatus 1. The image forming main conveyance section 32 is provided with a sheet sensor 33 and the image forming reverse conveyance section 34 is provided with a sheet sensor 35. Incidentally the sheet sensors 33 and 35 are examples and number and positions of the sensors are not limited to the present embodiment. The sheet sensors 33 and 35 can be configured with photo sensors to detect arrival of the sheet by a front edge of the sheet.

The image forming apparatus main conveyance section 32 is extending from the sheet feeding section 30 to the image forming section 31 and to the fixing device 40 so as to convey the sheet. Further the image forming apparatus main conveyance section 32 is extending to the large capacity sheet feeding device 2 so as to received the sheet fed from the large capacity sheet feeding device 2 and to convey the sheet to the image forming apparatus main body 3. The image forming reverse conveyance section 34 receives the sheet returned from the fixing device 4 and sends it to image forming main conveyance section 32. The image forming section 31 transfers a toner image onto the sheet based on the image data. The image forming section 31 is provided with an exposing section, a charging section and a developing section which are not illustrated. The charging section charges a surface of a photoconductive drum 31*a* evenly. The exposure section forms a latent image by scanning and exposing the surface of the photoconductive drum 31*a* with a laser beam in accordance with output information outputted from the control section 36 based on the image data. The developing section develops the latent image on the photoconductive drum 31*a* to be visualized by toner as a toner image.

The fixing device 4 is provided with a fixing main conveyance section 40 connected with the image forming main conveyance section 32 and a fixing section 42 is disposed on the fixing main conveyance section 40. The fixing main conveyance section 40 reaches to the sheet discharge section 43 outside the fixing device 4 at a downstream side of the fixing section 42. The fixing main conveyance section 40 is connected with an upstream side of the fixing reverse conveyance section 44 at a downstream side of the fixing section 42. Between the fixing main conveyance section 40 and the fixing reverse conveyance section 44, an unillustrated changeover section is disposed so as to enable switching the sheet conveyed from an upstream side of the fixing reverse section 40 between conveying to a downstream side of the fixing main conveyance section 40 and conveying to the fixing reverse conveyance section 44. The fixing main conveyance section 40 is provided with a sheet sensor 41 and the fixing reverse conveyance section 44 is provided with a sheet sensor 45. Incidentally, the sensors 41 and 45 are example only and positions and numbers thereof are not limited to the present embodiment. The sheet sensors 41 and 45 can be configured with photo sensors and detect arrival of the sheet by the sheet front edge.

The fixing reverse conveyance section 44 is provided with the orthogonal reverse section 46. The fixing reverse conveyance section 44 is connected with the image forming reverse conveyance section 34 of the image forming apparatus main body 3 at the downstream side of the orthogonal reverse section 46. Also, a stacking section 49 to stack sheet conveyed from the orthogonal reverse section 46 is disposed at downstream side of the orthogonal reverse section 46 in a direction to turn over the sheet and at a front surface side of the image forming apparatus 1. The sheet stacked in the stacking section 49 can be ejected to the front side to the image forming apparatus 1. The fixing device 4 is provided with doors 47 and 47 in its front surface side (front surface side of the image forming apparatus 1), and further provided a door opening/closing sensor 48 to detect open and close of the doors 47 and 47. The door opening/closing sensor 48 is configured with a limit switch and so forth to detect opening and closing action of the door 47. The image forming main conveyance section 32 and fixing main conveyance section 40 are equivalent to the main conveyance section of the present invention and the image forming reverse conveyance section 34 and the fixing reverse conveyance section 44 are equivalent to the reverse conveyance section of the present invention .

Figure 2:
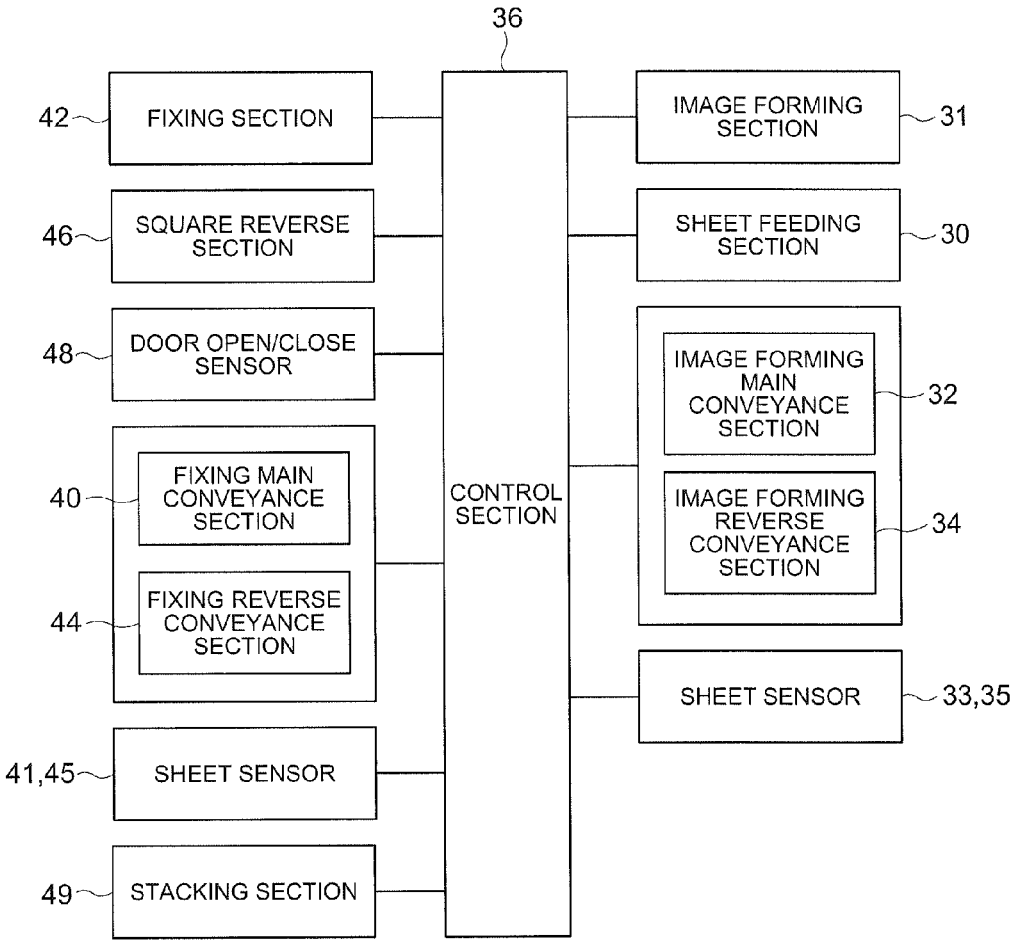
FIG. 2 is a view showing a control block of an image forming apparatus in an embodiment of the present invention.

Next a control block of the image forming apparatus 1 will be described with reference to FIG. 2. The entire image forming apparatus 1 is controlled by the control section 36. The control section 36 is configured mainly with a CPU and a program to operate the CPU and provided with a RAM representing a working area and a non-volatile memory storing operation parameters of each section of the image forming apparatus. To the control section 36, the sheet feeding section 30 and the image forming section 31 provided in the image forming apparatus main body 3 are connected so as to be controlled. Also, to the control section 36, the image forming main conveyance section 32 and the image forming reverse conveyance section 34 are connected to be controlled, thus the sheet conveyance in the image forming apparatus main body 3 is controlled by the control section 36.

Also to the control section 36, the sheet sensors 33 and 35 are connected to be controlled and detection results are transmitted to the control section 36. The control section 36 judges arrival of the sheet in the image forming main conveyance section 32 and in the image forming reverse conveyance section 34 by detection by the sheet sensors 33 and 35. In the above judgment, in case the arrival of the sheet delayed a predetermined time period from the estimated time of sheet arrive, the control section 36 judges that the jam occurred. The estimated time period can be calculated from a time when the sheet is detected by the sheet sensor located at the sheet feeding section or an upstream side and a conveyance speed. The estimated time period for the jam judgment is set in advance and stored in the non-volatile memory of the control section 36 and called up to be used for the judgment as needed. Incidentally, the method of judgment of the jam is not limited to the forgoing and it is possible to use a configuration that the jamming sheet is detected directly. The control section 36 conducts control that a given sheet is fed from the sheet feeding section 30 based on job data and conveyed by the image forming main conveyance section 32 then in the image forming section 31 an image is formed based on the image data included in the job data.

Further, to the control section 36, the fixing main conveyance section 40 in the fixing device 4 and the fixing reverse conveyance section 44 are connected to be controlled so that the control section 36 controls conveyance of the sheet P in the fixing apparatus 4. To the control section 36, the sheet sensors 41 and 45 are connected to be controlled so that the detection results of the sheet sensors 41 and 45 are transmitted to the control section. The control section 36 judges arrival of the sheet in the fixing main conveyance section 40 and the fixing reverse conveyance section 44 by the sheet sensors 41 and 45 to detect. In the judgment, in case arrival of the sheet is delayed the predetermined time period with respect to the estimated time of sheet arrive, the control section 36 judges that a jam occurred. The estimated time period can be calculated from the time of sheet detection by the sheet sensor in the sheet feeding section or on an upstream side and the conveyance speed. The estimated time for jam judgment is set in advance and stored in the non-volatile memory of the control section 36 and called up to be used for the judgment as needed. Incidentally, the method of judgment of the jam is not limited to the foregoing and it is possible to use a configuration that the jamming sheet is detected directly.

To the control section 36, the fixing section 42 is connected to be controlled. In the fixing section 42, an image formed by the image forming apparatus 3 is fixed on the sheet conveyed by the fixing main conveyance section 40. Also to the control section 36, the orthogonal reverse conveyance section 46 is connected to be controlled. In case the sheet conveyed via main conveyance section 40 and fixed by the fixing section 42 is required to be turned over, the conveyance path is switched to the fixing reverse conveyance section 44 and the sheet is conveyed by the fixing reverse conveyance section 44 then the control section conducts control of orthogonal reverse in the orthogonal reverse section 46. In case tuning over is not necessary, the sheet conveyed via the fixing main conveyance section 40 is conveyed to the sheet discharge section 43 outside the fixing device 4 but not conveyed to the fixing reversal conveyance section 44. To the control section 36 the stacking section 49 is connected to be controlled. The control section conducts control to eject the sheets stacked in the stacking section to the front surface side of the image forming apparatus 1 in a batch.

Figure 3:
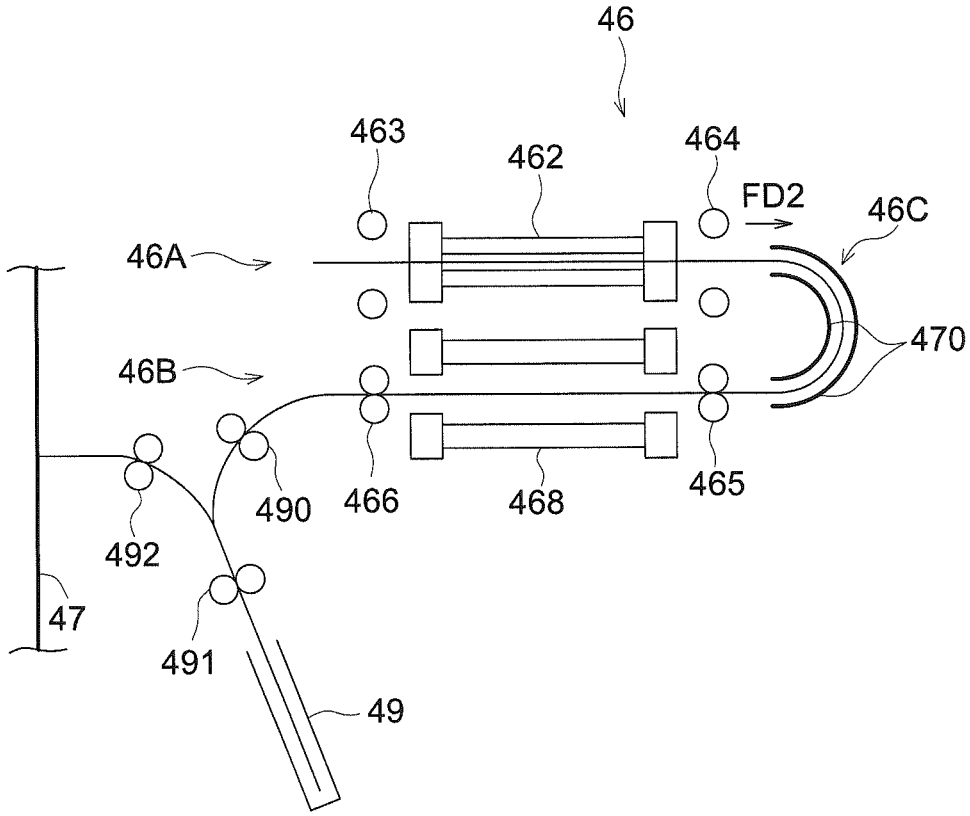
FIG. 3 is a view showing a side surface of the orthogonal reverse section of an image forming apparatus related to an embodiment of the present invention.
Figure 4A:
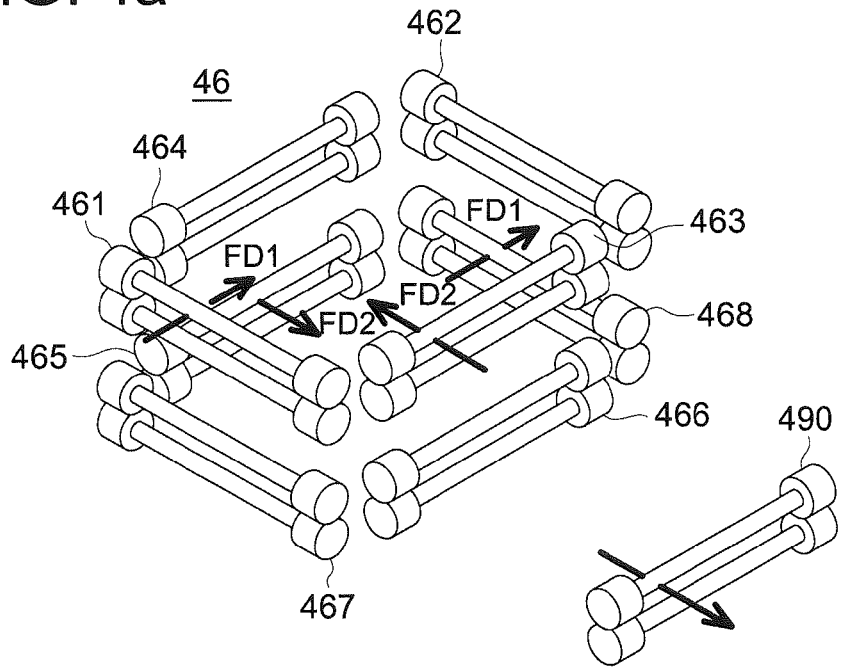
FIG. 4*a* is a perspective view showing an orthogonal reversal section.
Figure 4B:
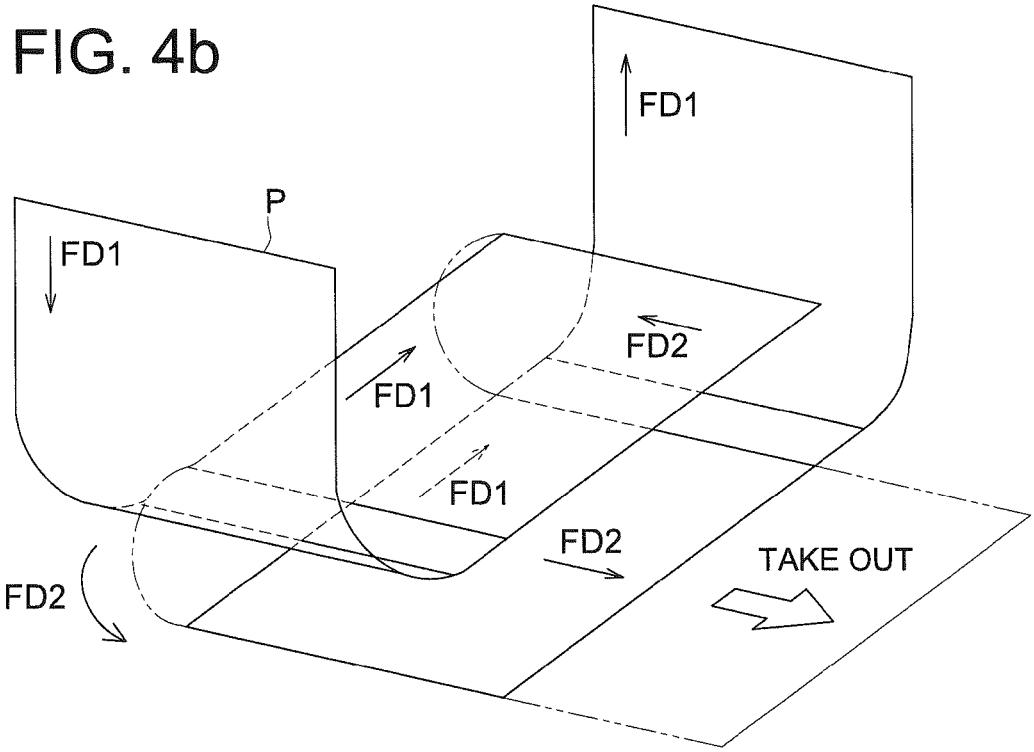
FIG. 4*b* is a perspective view showing an orthogonal reverse conveyance state of a sheet in an embodiment of the present invention.
Figure 5:
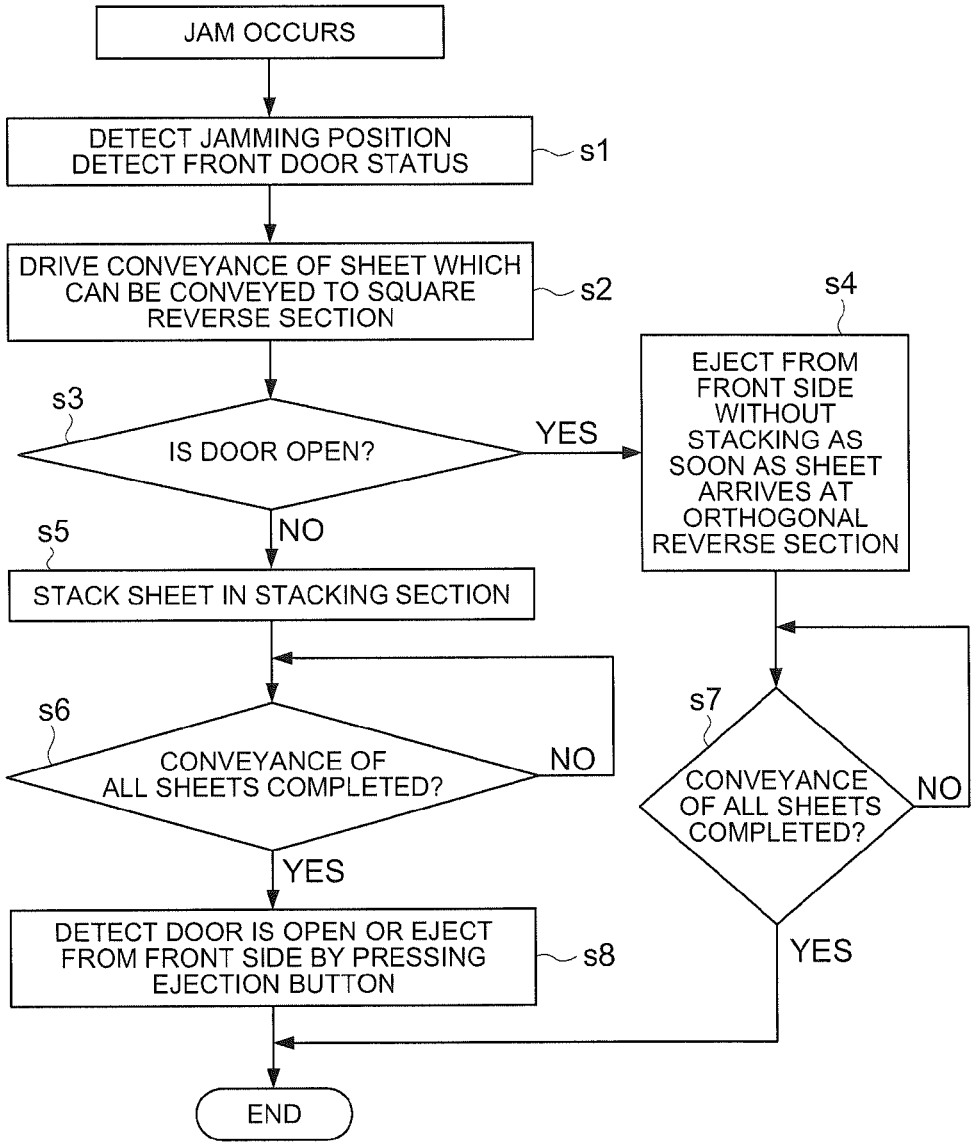
FIG. 5 is a flow chart showing a control procedure of remaining sheet ejection when a jam occurs in an embodiment of the present invention.
Figure 6A:
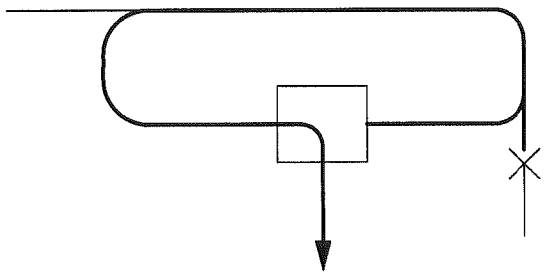
FIGS. 6*a*, 6*b*, 6*c*, 6*d* and 6*e* are schematic diagrams showing paths through which a remaining sheet can be ejected via an orthogonal reverse section when a jam occurs in an embodiment of the present invention.
Figure 6B:
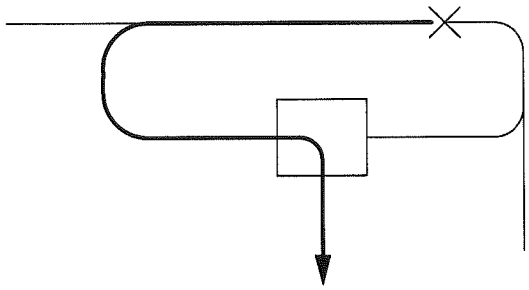
Figure 6C:
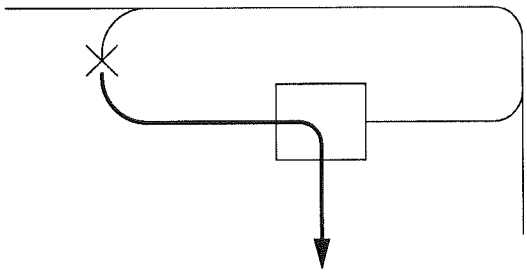
Figure 6D:
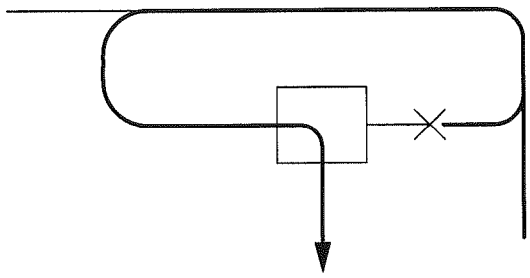
Figure 6E:
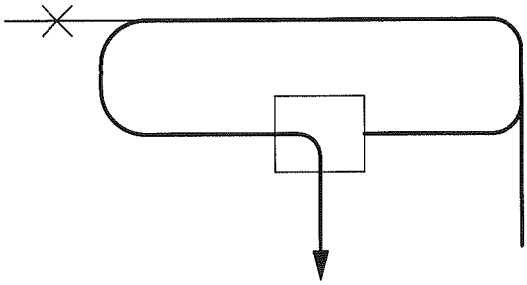

Next, a configuration of the orthogonal reverse section 46 will be described with reference to FIGS. 3 to 5. FIG. 3 is a side surface view showing a relevant portion of the orthogonal reverse section 46 and FIG. 4 is a perspective view schematically showing a configuration of the orthogonal reverse section 46 and reverse path of the sheet. The orthogonal reverse section 46 is provided with a conveyance path (conveyance direction FD2 of the sheet P) to orthogonally convey the sheet P in a direction perpendicular to the sheet conveyance direction FD1 in the fixing main conveyance section 40. The orthogonal reverse section 46 turns over the sheet P by rotating the sheet P around a rotation axis which is parallel to the sheet conveyance direction FD1 in the fixing position. The orthogonal reverse section 46 is provided with a first reverse section 46A, a second reverse section 46B and a rotation conveyance path 46C.

The first reverse section 46A is provided with a conveyance roller 461, a conveyance roller 462, a reverse roller 463 and a reverse roller 464. The conveyance roller 461 configured with a rotation roller and a driven roller in contact with the rotation roller is driven by an unillustrated drive mechanism so as to switch between a pressurized state (nipping state) and a separated state (nipping released state). The rotation roller is configured with a rotation axis and a pair of rollers disposed at both ends of the axis thereof and the driven roller is configured with a rotation axis and a pair of rollers disposed at both ends of the axis thereof. Incidentally, the configuration of the conveyance roller 461 is the same as the configurations of the conveyance roller 462, reverse rollers 463, 464, 465 and 466 as well as the conveyance rollers 467 and 468, and ejection rollers 490, 491 and 492 to be described. A drive motor to drive each roller is connected to the control section 36 to be controlled.

Each of the conveyance rollers 461 and 462 are disposed so that the rotation axes of the rollers are parallel to the sheet conveyance direction FD2, and both the conveyance rollers 461 and 462 are disposed oppositely in a separated state with a given distance. The given distance falls within the length of the sheet P in the conveyance direction. The reverse rollers 463 and 464 are respectively disposed at both ends of the conveyance rollers 461 and 462 in the axis direction and have rotation axes which are perpendicular to the rotation axes of the conveyance rollers 461 and 462, namely parallel to the conveyance direction FD1. The reverse roller 463 and the reverse roller 464 are disposed oppositely in a separated state with a given distance. The given distance falls within the length of the sheet P in the conveyance direction.

The conveyance rollers 461 and 462 receive the sheet P passed through the fixing position from the fixing main conveyance section 40 and convey the sheet P to a first switching position so as to switch the sheet conveyance direction FD1 to the sheet conveyance direction FD2 of the orthogonal reverse section 46. The first switching position is a position to enable the sheet P to be conveyed by the conveyance rollers 461 and 462 and nipped by the reverse rollers 463 and 464 then conveyed to the rotation conveyance path 46C.

The reverse rollers 463 and 464 convey the sheet P conveyed to the first switching position via the conveyance rollers 461 and 462 along the sheet conveyance direction FD2. Specifically, the reverse rollers 463 and 464 convey the sheet P in a way that the reverse rollers 463 is at an upstream side and the reverse roller 464 is at a downstream side in the sheet conveyance direction and feed the sheet P to the second reverse section 46B via the rotation conveyance path 46C.

The rotation conveyance path 46C is disposed between an exit side of the reverse roller 464 of the first reverse section 46A and an entrance side of the reverse roller 465 of the second reverse section 46B. The rotation conveyance path 46C is configured with a pair of guide plates 470 made of for example, a metal material and curved in a shape of an arc outward. Whereby, by passing the sheet between the pair of the guide plates 470, the sheet P is turned over 180° around the rotation axis which is parallel to the sheet conveyance direction FD1 in the transfer position without swapping the front and rear edge of the sheet (with the same edge).

The second reverse section 46B is provided with the reverse rollers 465 and 466 and conveyance rollers 467 and 468. The configuration of the reverse roller 465 is the same as that of the reverse roller 464 of the first reverse section 46A and the configuration of the reverse roller 466 is the same as that of the reverse roller 463 of the first reverse section 46A. The configurations of the conveyance rollers 467 and 468 are the same as that of the conveyance rollers 461 and 462. Descriptions of duplicated portion of each roller are simplified or omitted.

When the sheet P conveyed along the rotation conveyance path 46C is received, the reverse roller 465 conveys the sheet P to a second switching position so as to switch the sheet conveyance direction FD2 of the orthogonal reverse section 46 to the sheet conveyance direction FD1. The second switching position is a position enables the sheet P to be conveyed by the conveyance rollers 465 and 466 and nipped by the reverse rollers 467 and 468 then conveyed to a conveyance path in the fixing reverse conveyance section 44. As above, as FIGS. 4*b* and 5 show, different from the method such as switch back, the orthogonal reverse section 46 can turn over the sheet P without swapping the front and the rear edge of the sheet P. The reversed sheet P is turned over by passing through the orthogonal reverse section 46 and returned to the fixing reverse conveyance section 44. The sheet P returned to the fixing reverse conveyance section 44 is returned to the image forming reverse conveyance section 34 of the image forming apparatus main body 3 thus image forming on the reverse surface is possible.

Also, in the orthogonal reverse section 46 an ejection roller 490 is disposed at a conveyance direction (direction to reverse the sheet) side of the reverse rollers 466. In the orthogonal reverse section 46, in case the sheet is ejected from the conveyance path, sheet is convey by the reverse rollers 465 and 466 beyond the second switching position and ejection roller 490 moves the sheet forward further. The sheet conveyed by the ejection roller 490 is further conveyed by the ejection roller 491 and reaches to the stacking section 49. The sheet reached to the stacking section 49 is ejected from the stacking section 49 by the ejection roller 491 to rotate in a reverse direction. The sheet can be ejected to a front surface side (front surface side of the image forming apparatus 1) of the fixing device 4 by the ejection roller 492. In the above operation, the reverse rollers 465 and 466, the ejection rollers 490, 491 and 492 and the stacking section 49 represent the sheet ejection section of the present embodiment. In the above configuration, even in case the sheet is ejected without being stored in the stacking section 49, the ejection rollers 490 and 491 convey the sheet to the stacking section 49 side once and the sheet is reversed and conveyed by the rollers 491 and 492. However, it is possible to dispose a line to eject the sheet directly to the front surface side of the fixing device 4 (front surface side of the image forming apparatus 1) not through the stacking section 49. Incidentally, in the present embodiment, while the sheet is able to be ejected by further moving the sheet forward from a state that the sheet has reached to the second switching position, it is possible that the sheet can be ejected in a middle of the conveyance path or the sheet can be ejected by moving the sheet backward with respect to the conveyance direction.

Next a control procedure to eject the sheet via the orthogonal reverse section 46 will be described with reference to the flow chart in FIG. 5. Incidentally, the control procedure is conducted by the control section 36. The control section 36 judges occurrence of the jam based on the detection result of the sheet sensors 33, 35, 41 and 45 while the image forming apparatus is in course of operation. When the control section 36 judges that the jam occurred, the control of jam occurrence is conducted. First, in accordance with the judgment that the jam occurred, the jam position is detected (Step s1). The jam position is judged that the jam occurred between the sheet sensor which correctly detected arrival of the sheet and the sheet sensor which did not detect arrive of the sheet in the conveyance path. Further besides the detecting the jam position, a state of opening/closing of the door 47 disposed at the front surface side of the image forming apparatus 1 is detected (Step s1). The state of opening/closing is detected by the door opening/closing sensor 48.

In accordance with the jamming position, the control section 36 starts conveyance of the sheet in a position where the sheet can be conveyed to the orthogonal reverse section 46 as the remaining sheet ejection and enables turning over of the sheet in the orthogonal reverse section 46 (Step s2). The position where the sheet can be conveyed to the orthogonal reverse section 46 differs in accordance with the jamming position. FIGS. 6*a* to 6*e* show regions where the sheet can be conveyed in accordance with the jamming positions (x denotes the jamming position in the figure) and the sheet can be conveyed and ejected in bold line regions. The orthogonal reverse section 46 operates when the jam occurred even in case the orthogonal reverse is not conducted in the job in which the jam occurred.

When the sheet is conveyed to the orthogonal reverse section 46, whether or not the door 47 is open is judged (Step s3). In case the door 47 is open (Step s3, Yes) after conveying the remaining sheet to the orthogonal reverse section 46, the sheet is ejected from the conveyance path of the orthogonal reverse section 46 by the ejection rollers 490, 491 and 492, then without being stacked (non-stack) the sheet is ejected to the front surface side of the fixing device 4 (front surface side of the image forming apparatus 1) (Step s4). By conducting the control of the remaining sheet ejection in a predetermined time period, all the conveyable sheets are ejected to the front surface side of the fixing device 4 (Step s7) and the process is terminated. On the other hand, in case the door 47 is not opened (Step s3, No), the sheets ejected from the orthogonal reverse section 46 are sequentially stacked in the stacking section 49 via the ejection rollers 490 and 491 (Step s5). Conveyance is continued until all the conveyable sheets are stacked in the stacking section 49 (Step s6). When the conveyance of all the conveyable sheets is completed (Step s6, Yes) and opening of the door 47 in from surface is detected by the door opening/closing sensor 48 or pressing of an unillustrated ejection button by the operator is detected, by controlling the ejection rollers 491 and 492, the sheets stacked in the stacking section 49 are ejected to the front surface side of the fixing device 4 in a batch (Step s8) then the process is terminated. As above, there is effects that the sheet being conveyed in the image forming apparatus 1 can be moved outside the orthogonal reverse section 46 by the stacking section 49 and so forth and ejected, also in case the jam occurs in the image forming apparatus 1, the remaining sheet in the apparatus can be ejected quickly, thus labors of the operator to withdraw the plurality of units configuring the image forming apparatus is reduced and the down time is reduced.

As above, while the preferred embodiments of the present invention have been described, it is to be understood that changes and variations may be made without departing from the spirit or scope of the appended claims.

As described above, according to the present embodiments, the sheet in course of conveyance in the image forming apparatus can be moved outside the orthogonal reverse section and ejected, and in case the jam occurs in the image forming apparatus the sheet remaining inside the image farming apparatus can be quickly ejected thus there is an effect that labors of the operator to withdraw the plurality of the units configuring the image forming apparatus so as to address the jam is reduced and down time is reduced.

What is claimed is:

1. An image forming apparatus capable of both side image forming, comprising:

an ejected sheet section to which a sheet having an image fixed thereon is ejected;

a sheet stacking section to which a sheet remaining in the image forming apparatus is conveyed when jam of the sheet occurs;

a main conveyance section to convey a sheet inside the image forming apparatus and to convey the sheet to the ejected sheet section;

an orthogonal reverse section to receive the sheet from the main conveyance section and to reverse the sheet without swapping a front edge for a rear edge of the sheet by conveying the sheet in a direction perpendicular to a sheet conveyance direction of the main conveyance section;

a reverse sheet conveyance section to convey the reversed sheet from the orthogonal reverse section to an image forming section to fix an image on the sheet, a sheet removing section to remove the reversed sheet from the orthogonal reverse section and discharge the reversed sheet to the sheet stacking section along a direction to turn over the sheet by the orthogonal reverse section when the jam occurs;

a jam detection section to detect the jam of the sheet being conveyed in the main conveyance section or the reverse sheet conveyance section; and a control section to control operation of the image forming apparatus;

wherein when the jam occurs, the control section conducts remaining sheet ejection control that the main conveyance section or the reverse sheet conveyance section conveys the sheet remaining in the main conveyance section or in the reverse sheet conveyance section which can be conveyed to the orthogonal reverse section without passing through a position where the jam occurs in accordance with a jam position information detected by the jam detection section in case a sheet, other than a jamming sheet, remains in the main conveyance section, the reverse sheet conveyance section, or the orthogonal reverse section.

2. The image forming apparatus of claim 1, wherein the sheet ejection section moves the sheet in the orthogonal reverse section forward or backward along the direction in which the orthogonal reverse section to turns over the sheet.

3. The image forming apparatus of claim 1, wherein the sheet ejection section moves the sheet outside the orthogonal reverse section so as to eject sheet to a front surface side of the image forming apparatus.

4. The image forming apparatus of claim 1, wherein the sheet ejection section is provided with a stacking section to stack the sheet moving outside the orthogonal reverse section.

5. The image forming apparatus of claim 4, wherein the stacking section enables to eject the stacked sheets outside in a batch.

6. The image forming apparatus of claim 4, further comprising an ejection instruction section through which an operator instructs an ejection operation to eject the sheet stacked in the stacking section outside the image forming apparatus.

7. The image forming apparatus of claim 1, further comprising a door located at the front surface side of the image forming apparatus, and a door opening/closing detection sensor to detect an opening action of the door, wherein the control section conducts at least a control that the sheet ejection section ejects the sheet outside the orthogonal reverse section among the remaining sheet ejection controls, after the opening action of the door is detected by the door opening/closing detection sensor.

8. The image forming apparatus of claim 7, the control section conducts a control to stack the sheet to be moved outside the orthogonal reverse section in the stacking section disposed at the sheet ejection section in case the jam is detected by the jam detection section and the opening action of the door is not detected by the door opening/closing sensor.

* * * * *